US006286167B1

(12) United States Patent
Stolpmann

(10) Patent No.: US 6,286,167 B1
(45) Date of Patent: Sep. 11, 2001

(54) MATTRESS STRUCTURE

(75) Inventor: James R. Stolpmann, Charleston, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/585,029

(22) Filed: Jun. 1, 2000

Related U.S. Application Data

(63) Continuation of application No. PCT/US98/26295, filed on Dec. 11, 1998, now abandoned, and a continuation-in-part of application No. 09/064,297, filed on Apr. 22, 1998, now Pat. No. 6,115,861.

(60) Provisional application No. 60/069,097, filed on Dec. 11, 1997.

(51) Int. Cl.[7] ..... A47C 27/00

(52) U.S. Cl. ..... 5/737; 5/727; 5/710; 5/740; 5/953

(58) Field of Search ..... 5/706, 710, 727, 5/737, 738, 740, 953

(56) References Cited

U.S. PATENT DOCUMENTS

| | | |
|---|---|---|
| 371,938 | 10/1887 | Hinsdill . |
| 1,307,825 | 6/1919 | Marshall . |
| 1,746,709 | 2/1930 | Marshall . |
| 2,029,370 | 2/1936 | Heldenbrand . |
| 3,512,190 | 5/1970 | Buff . |
| 3,974,532 | 8/1976 | Ecchuya . |
| 4,086,675 | 5/1978 | Talbert et al. . |
| 4,606,087 | 8/1986 | Alivizatos . |
| 4,682,378 | 7/1987 | Savenije . |
| 4,689,844 | 9/1987 | Alivizatos . |
| 4,706,313 | 11/1987 | Murphy . |
| 4,903,359 | 2/1990 | Rogers . |
| 4,928,337 | 5/1990 | Chauncey . |
| 4,930,173 | 6/1990 | Woller . |
| 4,975,996 | 12/1990 | Evans et al. . |
| 5,002,336 | 3/1991 | Feher . |
| 5,022,110 | 6/1991 | Stroh . |
| 5,022,111 | 6/1991 | Fenner, Sr. . |
| 5,025,519 | 6/1991 | Spann et al. . |
| 5,031,261 | 7/1991 | Fenner, Sr. . |
| 5,036,559 | 8/1991 | Hargest . |
| 5,044,027 | 9/1991 | Moon . |
| 5,090,077 | 2/1992 | Caden et al. . |
| 5,231,717 | 8/1993 | Scott et al. . |
| 5,259,079 | 11/1993 | Visser et al. . |
| 5,311,623 | 5/1994 | Hendi . |
| 5,513,402 | 5/1996 | Schwartz . |
| 5,617,595 | 4/1997 | Landi et al. . |
| 5,638,564 | 6/1997 | Greenawalt et al. . |
| 5,666,681 | 9/1997 | Meyer et al. . |
| 5,680,662 | 10/1997 | Purdy et al. . |
| 5,802,646 | 9/1998 | Stolpmann et al. . |
| 6,115,861 * | 9/2000 | Reeder et al. ..... 5/727 |

FOREIGN PATENT DOCUMENTS

WO 96/33641 10/1996 (WO) .

* cited by examiner

*Primary Examiner*—Lynne H. Browne
*Assistant Examiner*—Robert G. Santos
(74) *Attorney, Agent, or Firm*—Bose McKinney & Evans LLP

(57) ABSTRACT

A mattress structure includes a cover configured to define an interior region and a mattress core including a shear material formed to include a plurality of adjacent sleeves. The mattress core is located in the interior region. The mattress structure also includes a support element located within each of the plurality of sleeves to provide support for a patient.

20 Claims, 3 Drawing Sheets

MATTRESS STRUCTURE

This application is a continuation of International Application PCT/US98/26295, with an international filing date of Dec. 11, 1998, now abandoned, which claimed the benefit of U.S. Provisional Application No. 60/069,097 filed on Dec. 11, 1997; and this application is a continuation-in-part of U.S. Application Ser. No. 09/064,297, filed Apr. 22, 1998, now U.S. Pat. No. 6,115,861.

BACKGROUND AND SUMMARY OF THE INVENTION

The present invention relates to mattress structures, and particularly to a mattress replacement for use on any deck for a bed. More particularly, the present invention relates to a mattress structure having a core support structure that is shaped and configured to provide improved support and firmness characteristics.

The illustrated embodiment of the present invention includes a mattress structure having a cover configured to define an interior region, and a mattress core including a shear material formed to include a plurality of adjacent sleeves. The mattress core is located in the interior region. The apparatus also includes a support element located within each of the plurality of sleeves to provide support for a patient.

In one illustrated embodiment, the support element includes at least one elongated foam cylinder. In another illustrated embodiment, the support element includes three elongated foam cylinders stacked within each of the plurality of sleeves.

In yet another illustrated embodiment, the support element includes a woven thermoplastic material. The woven thermoplastic material may be formed to include spring indentions or into any desired shape. The support elements may also include a plurality of preinflated air bags.

In still another illustrated embodiment, the support element includes a foam insert having a bottom foam section with a first ILD and a top foam section coupled to the bottom foam section. The top foam section has a second ILD less than the first ILD. End foam blocks may be coupled to opposite ends of the top and bottom foam sections. The illustrated end foam blocks have a third ILD greater than the first ILD.

In the illustrated mattress core, the plurality of sleeves are formed by a continuous sheet of material tacked to a bottom sheet at spaced apart locations. A web is coupled between adjacent sleeves to keep the sleeves upright and help control the firmness of the mattress core.

Additional features of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
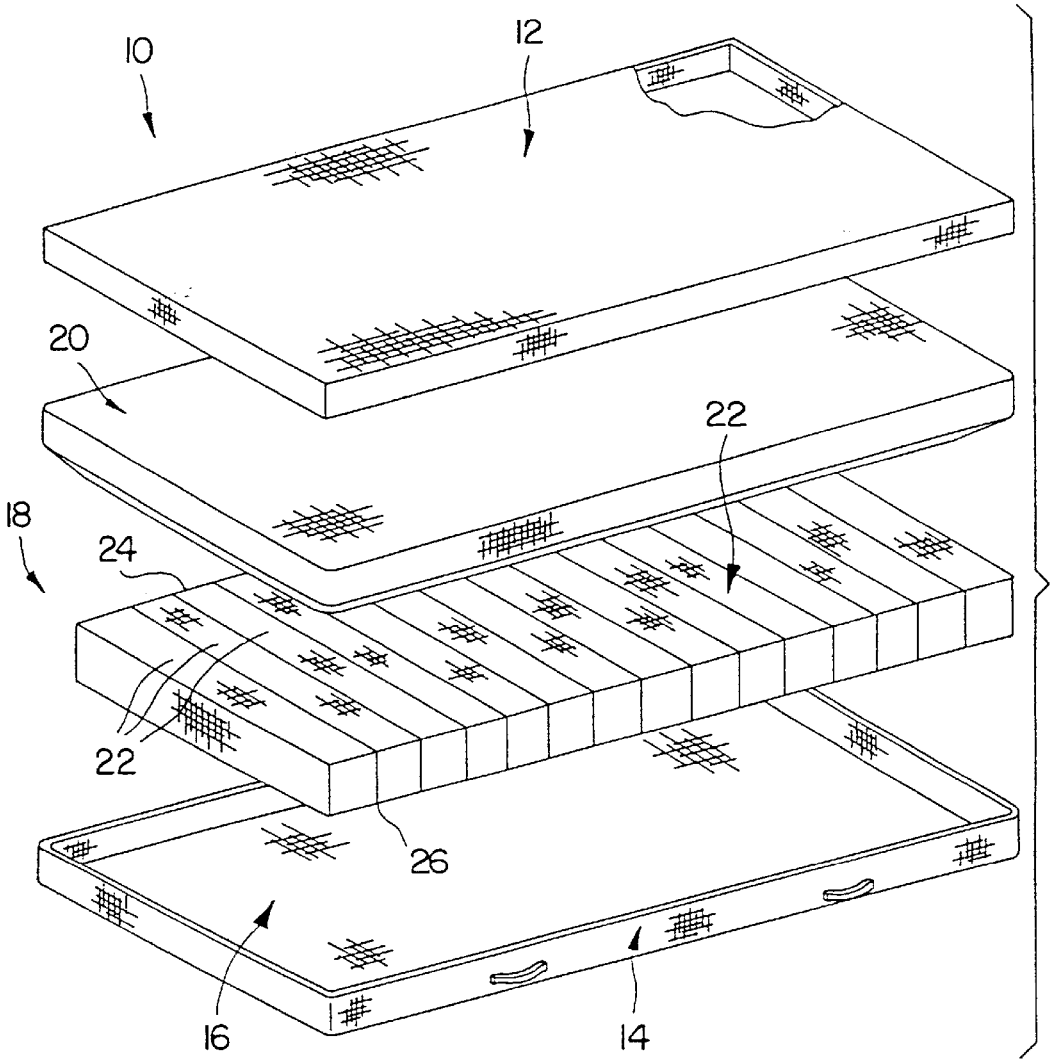
FIG. 1 is an exploded perspective view of a mattress structure of the present invention.

Referring, now to the drawings, FIG. 1 illustrates a mattress structure 10 of the present invention. The mattress structure 10 includes a top cover 12 and a bottom cover 14. The top and bottom covers 12 and 14 are connected together to form an interior region 16 of the mattress structure 10. Illustratively, the top and bottom covers 12 and 14 are formed from an impermeable and wipable or cleanable material.

The mattress structure 10 further includes a support core 18 and a shear material liner 20 located over the support core 18. The shear liner 20 is illustratively made from a low friction material so that the top cover 12 slides easily relative to the support core 18. Support core 18 includes a plurality of transversely extending sleeves 22 discussed in detail below with reference to FIGS. 2 and 5. Firmer sections such as foam side bolsters or air bolsters may be positioned adjacent side edges 24 and 26 to provide stiffer supports adjacent side edges 24 and 26 of the mattress structure 10, if desired.

Figure 2:
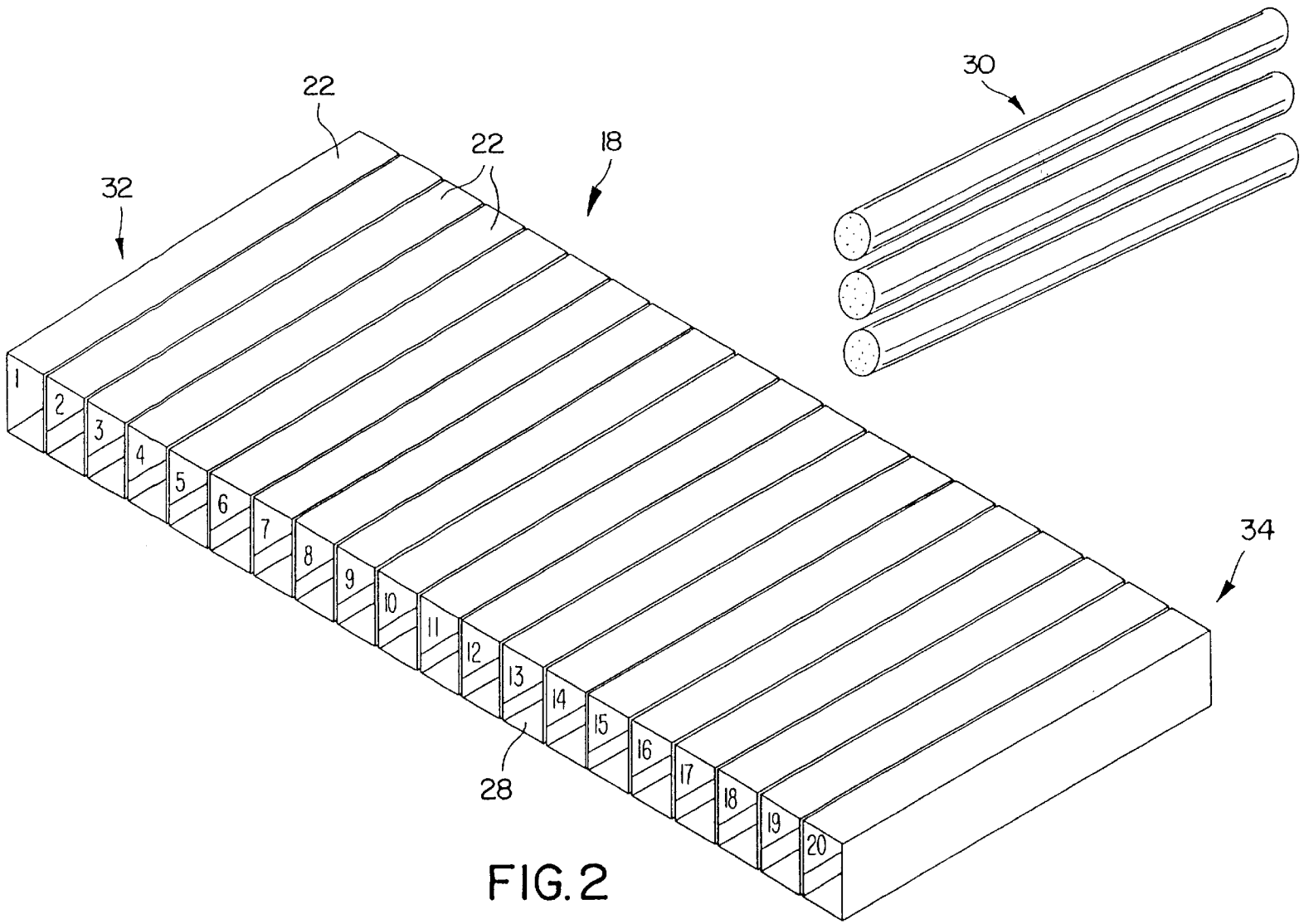
FIG. 2 is a perspective view of a bottom sheet and a plurality of transversely extending fabric sleeves for receiving material therein to provide a support surface for the mattress structure.

As illustrated in FIG. 2, the sleeves 22 are formed from a shear material which is coupled to a base sheet of material 28. Each sleeve 22 provides a separate region configured to receive support elements such as foam cylinders 30. Illustratively, three foam cylinders 30 are loaded into each of the sleeves 22 to provide support for a person resting on the mattress structure 10. The foam cylinders 30 are illustratively two inch (5 cm) diameter cylinders. The density of the foam material can be selected depending upon the particular desired firmness characteristics. The firmness is made different in different regions of the mattress structure 10 by selecting different firmnesses of insert material, such as the foam cylinders 30. The head end of the mattress is located at end 32 and the foot end is end 34.

An illustrative foam configuration and location includes cylinders 30 or other support elements having an ILD of about 17–21 in sleeves 1–8, shown in FIG. 2, with a support factor of 2.4. Support elements in sleeves 9–12 illustratively have an ILD of about 23–27 with a support factor of 2.4. Support elements in sleeves 13–15 illustratively have an ILD of 17–21 with a support factor of 2.4. Support elements in sleeves 16–20 include supports having separate top and bottom sections 37 and 39 such as heel logs 36 shown in FIGS. 3 and 4. Top section 37 has an ILD of about 7–10. Bottom section 39 has an ILD of about 11–15. Both top and bottom sections have a support factor of 2.4.

Figure 3:
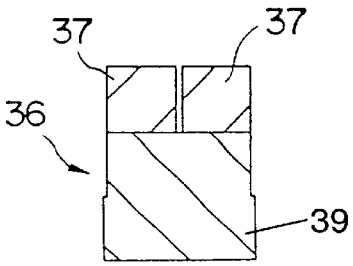
FIG. 3 is a sectional view taken through an illustrative heel section insert.
Figure 4:
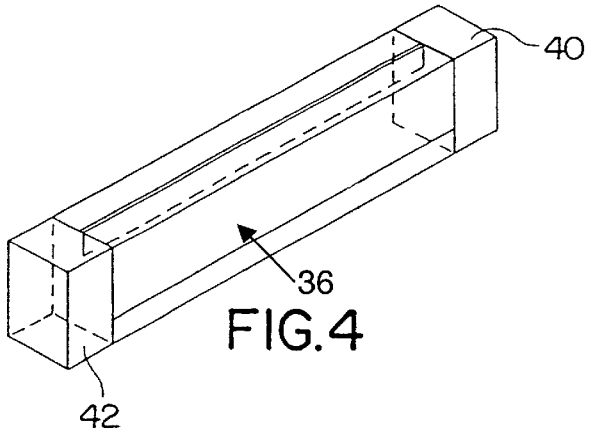
FIG. 4 is a perspective view of the heel section insert of FIG. 3.

FIGS. 3 and 4 illustrate the heel section logs 36. If desired, an operator can determine the location of the patient's heels near foot end 34 of mattress 10 and remove any inserts in sleeves 22 located beneath the patient's heels to provide extra pressure relief for the heels. FIG. 4 illustrates the heel section insert 36 having foam end blocks 40 and 42 having different densities which can be located within sleeves 22. End blocks 40 and 42 illustratively have an ILD of about 35–39.

As illustrated in FIG. 3, the top foam section 37 may be sliced along the longitudinal axis of the foam section 36 to soften the top section 37. Different textures may be provided to further control the firmness of the foam sections 36. The sections may be diced of waffled, if desired.

Figure 5:
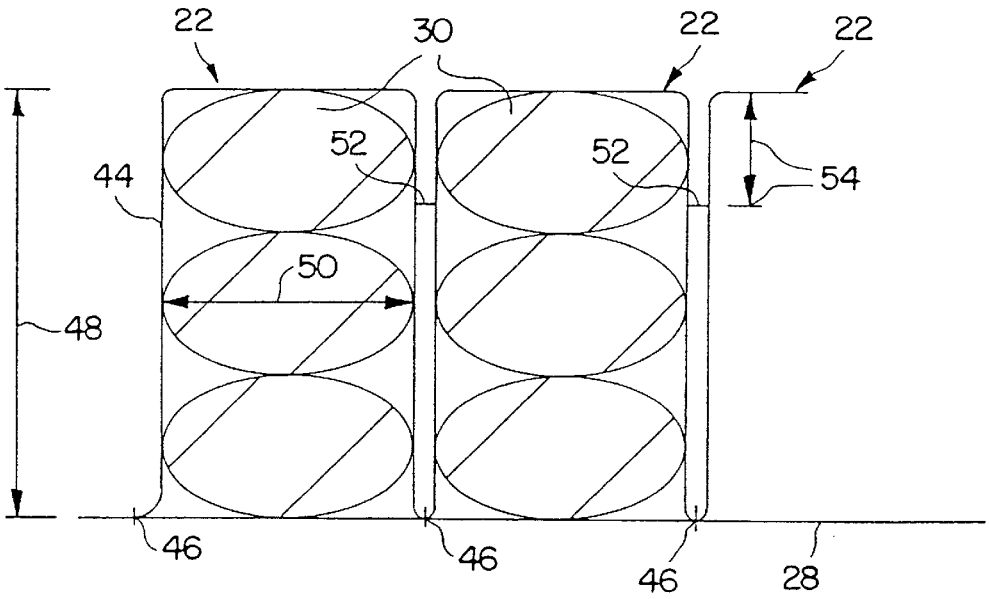
FIG. 5 is a sectional view taken through a portion of the support structure of FIG. 2 after support elements have been installed into the sleeves.

Additional details of the formation of sleeves 22 are illustrated in FIG. 5. Sleeves 22 are formed by a continuous sheet of shear material 44. The material 44 is stitched or RF welded to the base material 28 at spaced apart locations 46. The material is looped upwardly to form the sleeve 22 and then stitched at locations 46 as best illustrated in FIG. 5. Illustratively, the overall depth of sleeves 22 is about six inches (15.2 cm) as illustrated by dimension 48 in FIG. 6. Sleeves 22 have a width of about two inches (5.1 cm) to about four inches (10.2 cm) as illustrated by dimension 50. The adjacent sleeves 22 are tacked together by a web 52 using suitable stitching or RF welding. This web 52 helps to maintain each of the sleeves 22 upright. Illustratively, the tack stitch or web 52 is located a dimension of about one inch (2.5 cm) from a top surface of the sleeves 22 as illustrated by dimension 54 in FIG. 5. The web 52 can be at any desired location. The higher the web 52, the firmer the support surface. If the web 52 is too low, the sleeves 22 can spread open.

Figure 6:
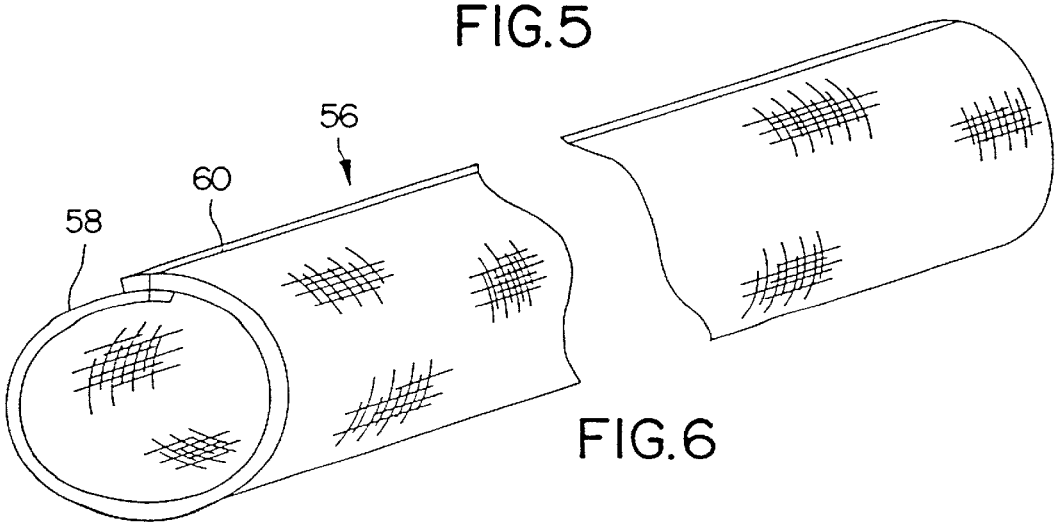
FIG. 6 is an illustration of another insert material configured to be loaded within the sleeves of FIG. 2, the insert material being made from a thermoformable woven thermoplastic material.

FIG. 6 also illustrates the foam logs 30 located within the sleeves 22. As discussed above, the foam logs 30 have various different ILDs depending upon the position of the foam logs 30 within the mattress core 18.

Instead of foam logs 30, other structural elements having desired load-deflection characteristics may be used within the sleeves 22. One example of such a structural element is illustrated in FIG. 6. This is a woven thermoplastic material 58 which has been thermoformed to form a cylinder 56. Illustratively, material 58 is Spacenet woven thermoplastic material available from Hoerscht Celanese disclosed in U.S. Pat. No. 5,731,062 which is incorporated herein by reference.

It is understood that the material 58 may be formed into other structural shapes which include spring indentations, spirals, or other suitable shapes instead of the cylinder 56 of FIG. 6. The thermoformable material 58 may be formed into an hourglass or elliptical shape. Shapes are selected to provide desired load-deflection characteristics. Materials having different fiber densities may be used in different sleeves 22 of the mattress core 18.

By providing structural elements to produce desired load-deflection characteristics, each sleeve 22 can be loaded with a desired load-deflection characteristic element. In addition, the mattress core 18 using the thermoformable woven material 58 is launderable or cleanable using an autoclave.

It is understood that other elements could be inserted into the shear sleeves 22 of mattress core 18. For instance, preinflated air bags or bags coupled to a pressure source may be used. A combination of various filling materials may also be used. For instance, air bags or gel packets may be positioned over a foam layer within the sleeves 22. Different material may be selected based upon the weight distribution of the patient. Bead or air filled bellows or bags, or other suitable insert materials, may be loaded within the sleeves 22 to support the person resting on the mattress structure 10.

Although the invention has been described in detail with reference to certain illustrated embodiments, variations and modifications exist within the scope and spirit of the invention as described and defined in the following claims.

What is claimed is:

1. A mattress structure comprising:

a cover configured to define an interior region;

a mattress core including a shear material formed to include a plurality of adjacent sleeves, the plurality of sleeves being formed by a continuous sheet of material tacked to a bottom sheet at spaced apart locations, the mattress core being located in the interior region; and a support element located within each of the plurality of sleeves to provide support for a patient.

2. A mattress structure comprising:

a cover configured to define an interior region;

a mattress core including a shear material formed to include a plurality of adjacent sleeves, the mattress core being located in the interior region;

a support element located within each of the plurality of sleeves to provide support for a patient, and a web coupled between adjacent sleeves.

3. The apparatus of claim 2, wherein the sleeves have a height of about 6 inches and the web is located about 1 inch from a top surface of the sleeves.

4. The apparatus of claim 2, wherein the support element includes at least one elongated foam cylinder.

5. The apparatus of claim 2, wherein the support element includes at least two elongated foam cylinders stacked on top of each other within the sleeves.

6. The apparatus of claim 2, wherein the support element includes a woven thermoplastic material.

7. The apparatus of claim 6, wherein the woven thermoplastic material is formed to include spring indentions.

8. The apparatus of claim 2, wherein the support element includes a plurality of preinflated air bags.

9. The apparatus of claim 2, further comprising a shear liner located over the mattress core and beneath the cover.

10. The apparatus of claim 2, wherein the support element comprises a foam insert having a central portion with a selected ILD, and first and second end foam blocks coupled to opposite ends of the central portion, the first and second end foam blocks each having an ILD greater than the ILD of the central portion, the central portion and the first and second end portions of the support element being located inside the sleeve.

11. A mattress structure comprising:

a cover configured to define an interior region, the cover having a depth dimension and a width dimension;

a mattress core including a shear material formed to include a plurality of adjacent sleeves, each sleeve having a depth dimension substantially equal to the depth dimension of the cover and a width dimension substantially equal to the width dimension of the cover, the mattress core being located in the interior region of the cover; and a plurality of support elements located within each of the plurality of sleeves to provide support for a patient, the plurality of support elements being configured to fill the plurality of sleeves to support the patient.

12. The apparatus of claim 11, further comprising a web coupled between adjacent sleeves.

13. The apparatus of claim 11, wherein the support element includes at least two elongated foam cylinders stacked on top of each other within the sleeves.

14. The apparatus of claim 11, wherein the support element includes a woven thermoplastic material.

15. The apparatus of claim 11, wherein the support element includes a plurality of preinflated air bags.

16. A mattress structure comprising:

a cover configured to define an interior region;

a mattress core including a shear material formed to include a plurality of adjacent sleeves, the mattress core being located in the interior region; and a support element located within each of the plurality of sleeves to provide support for a patient, the support element including a foam insert having a central portion with a selected ILD, and first and second end foam blocks coupled to opposite ends of the central portion, the first and second end foam blocks each having an ILD greater than the ILD of the central portion, the central portion and the first and second end portions of the support element being located inside the sleeve.

17. The apparatus of claim 16, wherein the ILD of the first and second end foam blocks is about 35 to about 39.

18. The apparatus of claim 16, wherein the central portion of the foam insert comprises a bottom foam section and a top foam section coupled to the bottom foam section, the top foam section having an ILD less than an ILD of the bottom foam section.

19. The apparatus of claim 18, wherein the top foam section is sliced along a longitudinal axis of the top foam section.

20. The apparatus of claim 18, wherein the bottom foam section has an ILD of about 11–15 and the top foam section has an ILD of about 7–10.

* * * * *